United States Patent [19]

Meister et al.

[11] Patent Number: 4,695,168

[45] Date of Patent: Sep. 22, 1987

[54] ELECTRONIC WATCH HAVING TWO MOTORS AND COMPRISING MEANS FOR PERPETUALLY INDICATING THE DAY OF THE MONTH

[75] Inventors: Pierre-André Meister, Bienne; Pierre Schmidli, Evilard; Bertrand Soltermann, Diesse, all of Switzerland

[73] Assignee: ETA SA Fabriques D'Ebauches, Grenchen, Switzerland

[21] Appl. No.: 943,013

[22] Filed: Dec. 18, 1986

[30] Foreign Application Priority Data

Dec. 18, 1985 [CH] Switzerland ..... 05437/85

[51] Int. Cl.[4] ..... G04B 19/24

[52] U.S. Cl. ..... 368/31; 368/34; 368/28; 368/204

[58] Field of Search ..... 368/28–40, 368/203, 204

[56] References Cited

U.S. PATENT DOCUMENTS 4,211,065 7/1980 Schmitz et al. ..... 368/1

4,300,224 11/1981 Nakazaki ..... 368/201

4,456,386 6/1984 Dellea ..... 368/201

*Primary Examiner*—Bernard Roskoski

*Attorney, Agent, or Firm*—Pollock, Vande Sande & Priddy

[57] ABSTRACT

A watch comprises a first motor (2) for driving a time display (4), a second motor (23) for driving means (20) for numerically indicating the day of the month, a perpetual-calendar circuit (30), a first transmission circuit (40), a non-volatile memory (41), a second transmission circuit (42), and a detection circuit (43) for generating a signal (S43) when an energy supply cell is being inserted to energize the circuits. The calendar circuit includes counters (31, 32, 33) generating a calendar signal (S30) representative of the date. This signal is periodically transferred to the non-volatile memory by the first transmission circuit in response to periodic signals (Sx, Sm, Sa). The date at which the watch stops at the end of the cell's life remains memorized in the non-volatile memory and in the day of the month indicating means. When a new cell is inserted, the signal representative of the date at which the watch stopped is transferred from the non-volatile memory to the calendar circuit by the second transmission circuit in response to the signal (S43) generated by the detection circuit.

3 Claims, 2 Drawing Figures

ELECTRONIC WATCH HAVING TWO MOTORS AND COMPRISING MEANS FOR PERPETUALLY INDICATING THE DAY OF THE MONTH

BACKGROUND OF THE INVENTION

1. Field of the Invention

This invention relates to an analogue electronic watch having two motors, one for driving the time display, the other for driving means for numerically displaying the day of the month, and is more particularly concerned with a watch comprising, in addition, a perpetual-calendar circuit. This circuit includes day, month and year counters and issues a date indicating signal to a control circuit which activates the second motor by causing it to move forward by a number of steps whereby the numerical display of the day of the month may correspond to the contents of the day counter, and thus agree with the date shown by a perpetual calendar.

2. Prior Art

Such watches are known and a form of embodiment thereof is described in U.S. Pat. No. 4,300,222. The watch described in this specification comprises a perpetual calendar displaying the day of the month and, possibly, the day of the week. Although the calendar is reliable when the watch operates normally, a change of cell causes the counters to be in states that are in no way related to the date since the calendar circuit is no longer able to generate correct signals.

After a change of cell, the counters, the day of the month display and the time display of the watch, need to be corrected. Correcting the day of the month display is done in the usual way. However, correcting the counters is hardly possible for the user or for a watch-repairer not having the required equipment. Indeed, to diminish the time spent, each counter must be corrected separately and this involves complex manipulations. Moreover, for such correction to be possible, the contents of the counters must be known and this information is not displayed by the watch.

A change of cell can therefore only be performed in the factory or in an after-sales service centre and this places an undesirable constraint in the use of an otherwise most practical watch.

SUMMARY OF THE INVENTION

An object of the invention is to overcome this drawback by providing a watch having a perpetual calendar that only involves, after a change of cell, an easy correction of the day of the month display by the bearer of the watch.

To this end the watch provided by the invention comprises:

- a time-keeping circuit able to generate a time base signal;
- a first motor activatable by said time base signal;
- a control mechanism including a first gear-train arranged to be driven by said first motor, a contact activatable daily by said first gear-train as the watch switches from one day to the next to generate a daily signal, and a correction member;
- an analogue time display means arranged to be driven by said first gear-train and alterable by said correction member;
- a perpetual-calendar circuit including day, month and year counters connected in series, and a correction circuit, linked to the month and year counters, for setting to 1 the contents of the day counter at the end of each short month, said calendar circuit being also arranged to generate, in response to the dialy signal applied to the input of the day counter, a calendar signal, representative of the contents of the counters, showing the date and taking into account, by virtue of the correction circuit, the number of days in each month of the year and the leap years, and a monthly signal as the calendar signal switches from one month to the next;
- a second motor;
- a second gear-train arranged to be driven by the said second motor;
- analogue display means for displaying the day of the month and controlled by said second gear-train;
- a control circuit, connected to the calendar circuit and arranged to receive, in addition, said daily signal and a retrieval signal having a frequency greater than that of said daily signal, for issuing a control signal to said second motor, said control signal serving to alter the day of the month by one day in response to said daily signal, and by the required number of days at the end of a short month in response to said retrieval signal, whereby the day of the month display will agree with the contents of the day counter on the first day of each month;
- a cell for supplying energy to said circuits;
- a reprogrammable non-volatile memory;
- a first transmission circuit for transferring, as each day, each month and each year moves on to the next, the contents of said day, month and year counters, respectively, to said perpetual memory;
- a replacement cell detection circuit arranged to generate a detection signal when the voltage of said replacement cell is applied across said circuits; and
- a second transmission circuit for transferring, in response to said detection signal, the contents of said non-volatile memory to the counters of said calendar circuit.

One advantage of the invention is that, after a change of cell, the permanent calendar circuit may be made to perform again correctly by merely correcting the numerical indication of the day of the month that is shown, a simple operation that can be done by the user in the same way as with ordinary calendar watches.

DETAILED DESCRIPTION OF THE DRAWINGS

Figure 1A:
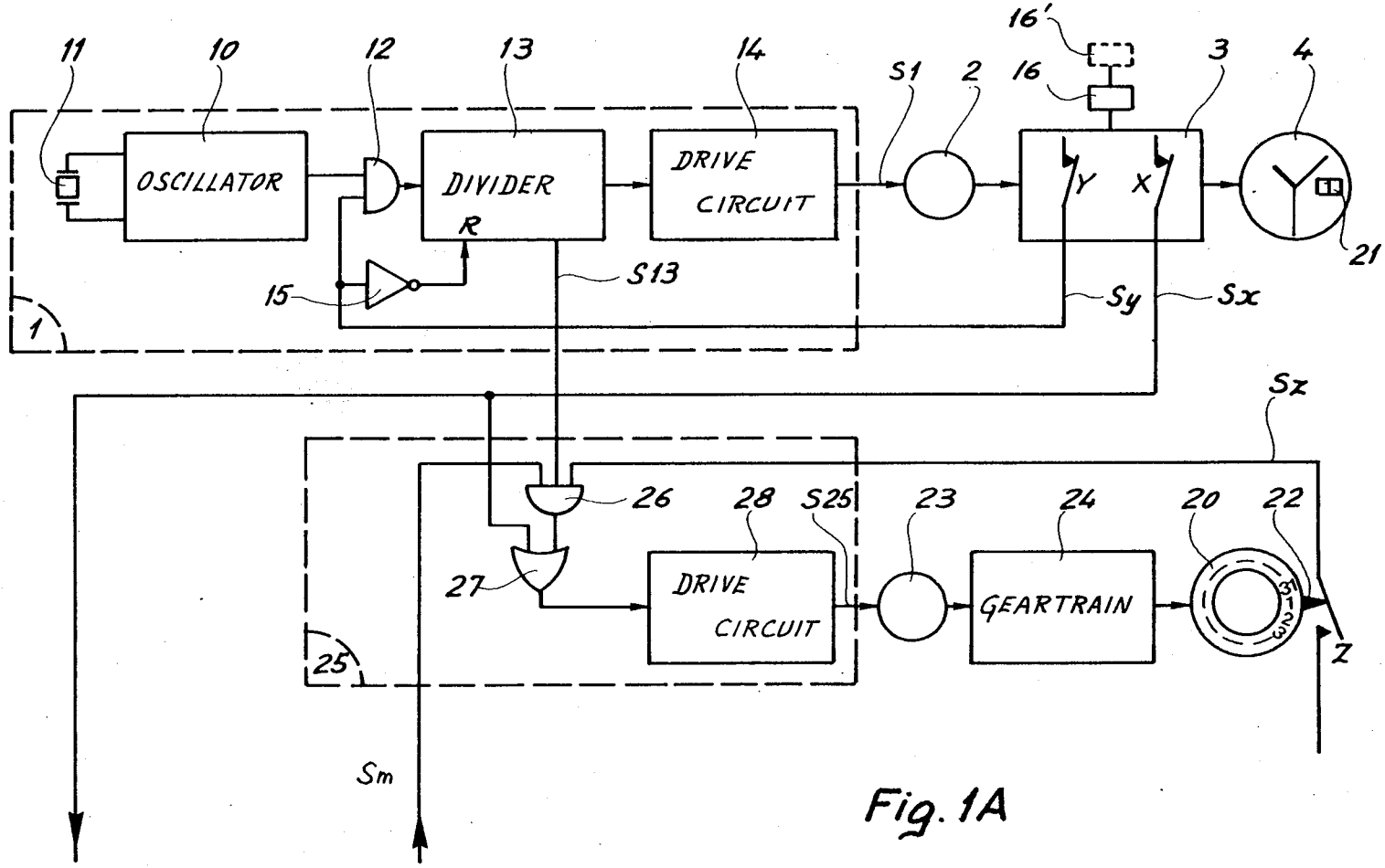
FIGS. 1A and 1B together show, in block diagram form, a preferred form of embodiment of the watch provided by the invention.

The illustrated watch comprises a time-keeping circuit 1 which supplies a clock signal S1 to a first motor 2 which, via a control mechanism 3, drives a time display 4 having hour, minute and second hands.

Time-keeping circuit 1 includes an oscillator 10 whose frequency is stabilized by a quartz resonator 11, generating a signal of e.g. 32768 Hz, a two-input AND gate 12 having one input connected to the output of the oscillator, a frequency divider 13 having a first input connected to the output of AND gate 12, and a drive circuit 14 which receives from a first output of frequency divider 13 a 1 Hz signal and issues signal S1 on its own output. Frequency divider 13 further has a second output which issues a retrieval signal S13 having a frequency of about 10 Hz, and a reset input R connected to the output of an inverter 15 whose input is connected to the second input of AND gate 12.

Motor 2 may for instance be a stepping motor that rotates in one direction only. It drives, in control mechanism 3, a first gear-train, not shown, which causes the hands of display 4 to move forward. This gear-train also actuates a first, daily contact X, causing it to close it when the watch moves on to the next day, i.e. at midnight, in order to generate a daily logic signal Sx. It will be assumed that signal Sx is low when contact X is open and high when closed. The same applies to signals generated by other contacts described later.

Control mechanism 3 further comprises correction means, not shown, for resetting the watch by means of a correction member, e.g. a time-setting crown 16 shown in an inner, neutral position. Crown 16 may be moved to an outer, correction position 16' in which it is mechanically coupled with the hands, enabling the indications of display 4 to be corrected in a conventional manner.

Crown 16 further acts, irrespective of its angular position, on a second, position contact Y that generates a logic signal Sy which is applied to the second input of AND gate 12. Contact Y is closed when crown 16 is in the neutral position, and open when crown 16 is in the correction position.

The components described so far are those of a conventional analogue watch that operates as follows. When crown 16 is in its inner, neutral position, with signal Sy high, AND gate 12 lets the signal from oscillator 10 through to frequency divider 13. The reset input R Iof the divider 13 being low, the circuit issues the 1 Hz signal to the input of drive circuit 14 which in turn issues clock signal S1 to motor 2. Motor 2 drives, via the first gear-train, the hands of time display 4 and actuates contact X by means of this gear-train. The daily signal Sx generated by contact X switches at midnight from low to high and returns shortly afterwards to low where it remains until the beginning of the following day.

In the outer, correction position 16' of crown 16, signal Sy is low, thus closing AND gate 12 and resetting frequency divider 13 which, in these conditions, receives no signal. The same applies to motor 2, which remains idle. The hands of display 4 can then only be moved by crown 16 which, in this position 16', is connected to the gear-train to enable accurate time-setting of the watch. When the hands, driven by crown 16, go through the midnight point, contact X is of course actuated as if the hands were driven by the motor 2.

The watch further comprises a perpetual day of the month indicator giving the number of each day of a month. This information is provided by a day of the month display 20 embodied in the usual way by a disc bearing numbers 1 to 31. In FIG. 1A, display 20 is separate from display 4, but in practice the day of the month will appear in an aperture 21 of the time display 4.

Display 20 further activates a contact Z on the first day of each month, as by means of a cog 22 provided on the disc opposite number 1. Contact Z generates a first day of the month signal Sz which goes high at the start of the first day of each month and which reverts to low one day later so to remain till the beginning of the next month.

Disc 20 is driven forward at the start of each new day by a second unidirectional motor 23 which drives disc 20 via a second gear-train 24, and motor 23 is activated by a control signal S25 generated by a control circuit 25.

Circuit 25 comprises a three-input AND gate 26, a two-input OR gate 27 having one input connected to the output of AND gate 26, and a drive circuit 28 connected to the output of gate 27 and which issues on its output control, signal S25. One input of AND gate 26 receives retrieval signal S13, a second receives first day of the month signal Sz, and a third receives a monthly signal Sm, described later. The second input of OR gate 27 receives daily signal Sx.

Figure 1B:
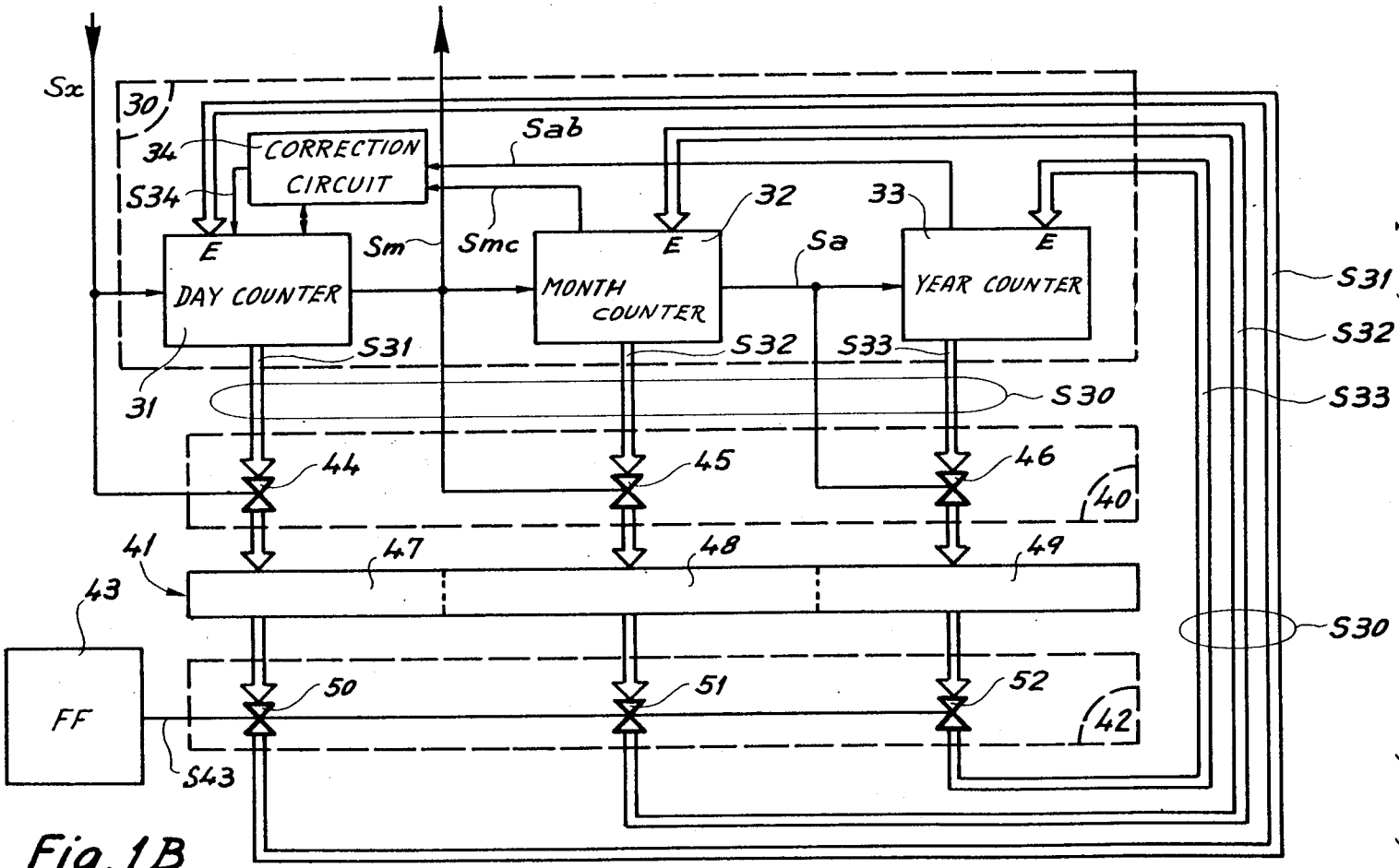

The watch further comprises (FIG. 1B) a perpetual calendar circuit 30 having a five-bit day counter 31 which counts in thirty-ones, a four-bit month counter 32 which counts in twelves, and a two-bit year counter 33 which counts in fours. These counters are connected in series. Counter 31 receives on its input daily signal Sx and issues on one output, at the beginning of each month, monthly signal Sm to counter 32 which, in turn, issues at the beginning of each year an annual signal Sa to counter 33. Each counter further issues, on another output, a signal indicative of its contents, i.e. S31 for counter 31, S32 for counter 32 and S33 for counter 33. Additionally, counter 32 issues a signal Smc indicative of a short month and counter 33 issues a signal Sab indicative of a leap year in a four-year cycle.

Circuit 30 further has a correction circuit 34 which receives signals Smc and Sab. Circuit 34 generates, from signals Smc and Sab, a correction signal S34 for counter 31 to set its contents to 1 when the calendar switches from a short month to the following month. In this way, the contents of counter 31 will always agree with what is shown by a perpetual day of the month indicator.

The switch to 1 of the contents of counter 31 generates signal Sm. It will be assumed that this signal is normally low and goes high at midnight, when the calendar circuit moves from one month to the next, and reverts to low at the latest the following day.

Signals S31, S32 and S33 together make up an eleven bit calendar signal S30 representative of the date in counters 31, 32 and 33. Each of these counters further has an input E for setting them, by means of a logic signal, to a given day, month and year respectively. This date setting can however only be done at the factory.

Circuit 30 will not be described in detail since such circuits are known and a form of embodiment is described in the US patent specification referred to earlier.

Monthly signal Sm is applied to the third input of AND gate 26 in control circuit 25, which operates as folows. Assuming disc 20 and calendar circuit 30 have been set to the correct date, daily signal Sx, which reads at midnight the input of drive circuit 28 via OR gate 27, causes disc 20 to move forward by one day. This same signal also increments by one unit day counter 31. If disc 20 and day counter 31 show a day other than the last day of a month, signals Sz and Sm will respectively be high and low. Retrieval signal S13 will in this case be blocked by AND gate 26 through signal Sm. Disc 20, having rotated through one step, will thus remain in this position until contact X is closed again. But if disc 20 shows the 30th day of a thirth-day month, signal Sx at midnight will cause disc 20 to rotate to 31 and the contents of day counter 31 to switch to 1. Signal Sm then goes high, which is the same logic level as signal Sz since contact Z is closed for this position of disc 20. It is assumed that retrieval signal S13 is made up of pulses and has a frequency of say 8 Hz. This signal can, under these conditions, transit through AND gate 26 and OR gate 27 to reach circuit 28. In response to each pulse of signal S13, circuit 28 causes disc 20 to move forward by one day. In the present case, with disc 20 indicating 31, a simple pulse of signal S13 is sufficient to move disc 20 to 1 and to bring it into agreement with the contents of counter 31. In this new position of disc 20, contact Z is open and signal Sz is low. This causes signal S13 to be blocked by AND gate 26. Disc 20 will therefore remain in this position until the next daily signal Sx, which will cause disc 20 and the contents of counter 31 to go to 2. In these states of disc 20 and of counter 31, signal Sz is high, contact Z being closed, and signal Sm is low. Signal Sm thus causes signal S13 to be blocked by AND gate 26 until the contents of counter 31 again are 1.

The same thought process would show that at the end of a twenty-nine day month of February in a leap year, AND gate 26 of control circuit 25 would allow two consecutive pulses of retrieval signal S13 to go through, causing disc 20 to rotate rapidly from 30 to 1. Similarly at the end of a twenty-eight day month of February, three pulses of the retrieval signal S13 would cause disc 20 to rotate from 29 to 1.

Besides the above described function of contact Z, the latter further enables, in the event of a malfunction of disc 20, synchronizing with the contents of day counter 31 on the first day of each month. This is due to the fact that, whatever indication is provided by disc 20 when the contents of day counter 31 are 1 and monthly signal Sm is high, AND gate 26 will allow the required number of pulses of retrieval signal S13 to transit through it in order to rotate disc 20 to the first day of the month.

Drive circuit 28 issues on its output control circuit signal S25 whenever a signal issues on the output of OR gate 27. The duration of this latter signal therefore does not affect control signal S25. Thus, if a pulse of retrieval signal S13 is interrupted and shortened through contact Z being opened, disc 20 will still rotate normally.

To move disc 20 by one day, control signal S25 may contain only one pulse causing motor 23 to rotate one step. However, to reduce the torque that needs to be supplied by the motor and lower its consumption, it is preferred for disc 20 to be rotated by driving motor 23 through N steps in response to a control signal S25 made up of a series of N consecutive pulses. The triggering of one pulse of a series automatically generates the other pulses in the series, such that disc 20 can only move through whole days.

Control circuit 25 can also be designed to generate the control signal S25, that causes disc 20 to advance by the required number of days at the end of a short month, on the basis of the information supplied by signals Smc and Sab, instead of that supplied by signal Sz. An embodiment of such a circuit is described, for example, in the US patent specification mentioned earlier. Contact Z then serves no purpose. This arrangement however has the drawback of not enabling disc 20 in the case of a malfunction of the latter to be synchronized with the contents of counter 31 on the first day of each month.

The circuits of the described watch are supplied with energy by a cell not shown. After initially time and date setting the watch the latter will carry on showing the correct time so long as the voltage of the cell remains above a critical threshold.

After a while, as the cell runs out, its voltage will drop below the critical threshold and the watch will stop. This stoppage entails the loss, and this is important, of the date contained in counters 31, 32 and 33 of calendar circuit 30 since these counters form a memory which is cleared when it no longer receives sufficient energy. Replacement of the used cell by a new cell does not, of course, enable this date to be recovered since the counters are then in random states, or in a state in no way related with the date on which the watch stopped, such date continuing however to appear on disc 20.

When the cell is replaced, the counters thus need to be reprogrammed. This is a complex operation requiring the watch to be sent back to the factory, a major inconvenience.

To avoid this drawback, the watch further comprises a first transmission circuit 40, a reprogrammable non-volatile memory 41 also referred to as EEPROM, a second transmission circuit 42 and a voltage detection circuit 43.

Transmission circuits 40 and 42 can, for instance, be made up of transmission gates which are known electronic components, while the non-volatile memory, with its interface circuits that enable items of information to be entered and read, can with advantage be of the FAMOS type, also known. The use of such a memory in the watchmaking art is known for instance in Swiss patent specification No. 534913 which describes a frequency correction logic circuit wherein the contents of the non-volatile memory governs the operation of a watch.

First transmission circuit 40 enables the contents of the counters of calendar circuit 30 to be transferred to non-volatile memory 41 in response to a transfer signal. To this end, circuit 40 comprises a first series 44 of five transmission gates. These gates are connected, firstly, to the output of counter 31 so as to receive the five-bit signal S31 and, secondly, to the input of a first, five-bit section 47 of memory 41. These gates are controlled by the transfer signal which in this case is daily signal Sx.

Thus, every day at midnight when the content of counter 31, representative of the day of the month, changes, the new date is transferred from counter 31 to section 47 of memory 41, in which it remains memorized irrespective of the voltage of the cell.

Second transmission circuit 42 has the same structure as circuit 40. It thus also has a first series 50 of five transmission gates. These gates are connected, firstly, to the output of section 47 of memory 41 so as not to receive signal S31 and, secondly, to the input E of counter 31.

When changing the cell, circuit 43, which is a monostable flip-flop of a known type, generates a detection signal S43 that indicates that the voltage across the terminals of the circuits is again at least equal to the critical threshold. This signal is used as the transfer signal for second transmission circuit 42. Thus, at that instant, when the state of counter 31 is random, counter 42 receives on its input E the signal S31 that existed at the time the watch stopped.

Circuit 40 further comprises a series 45 of four transmission gates for transferring each month, in response to signal Sm, signal S32 to a section 48 of memory 41. Finally, a series 46 of two transmission gates enables signal S33 to be transferred to a section 49 of memory 41.

Like circuit 40, transmission circuit 42 further comprises a series 51 of four transmission gates, connected here to the output of section 48 and to input E of counter 32, and a series 52 of two transmission gates connected to the output of section 49 of memory 41 and to input E of counter 33, signal S43 acting as transfer signal for all these gates.

As a result, when changing the cell, calendar circuit 30 receives, from non-volatile memory 41, the signal S30 that existed at the instant the watch stopped, thus setting the counters of this circuit in a state corresponding to the date when the watch stopped.

Once the cell has been changed, all that needs to be done is to set the date and time displayed by the watch by rotating the hour hand as many times 24 hours as days have elapsed since the watch stopped. As this operation may be lengthy, a much faster way of date setting will be described below.

The watch described above can usefully further comprise a known time-zoning device involving magnetic positioning. Crown 16 must then be able to move into a second correction position, not shown, in which it can act on part of the first gear-train to move, by an integral number of hours, only the hour hand and to activate contact X. Each time the hour hand moves past midnight, disc 20 moves forward by one whole day and counter 31 is incremented by one unit. In the second correction position of crown 16 contact Y remains closed to enable the watch to carry on working normally.

If the watch is provided with the time-zoning device mentioned above, second motor 23 should be able to rotate in both directions, i.e. be bidirectional. Control mechanism 3 must then have means, e.g. contacts, for ascertaining, by means of a discrimination circuit not shown but known, the direction of rotation of crown 16 when it is in a correction position. The discrimination circuit generates a logic signal which is applied to an input not shown of circuit 28, and to an input not shown of counters 31, 32 and 33. One logic level of this signal will correspond to forward rotation of the motor, causing disc 20 to advance, and to incremation of the counters, whereas the other logic level will correspond to backward rotation of the motor and decrementation of the counters. The day of the month displayed by disc 20 will, under the above conditions, always agree with the contents of counter 31, whatever the direction of rotation of the hour hand at the time contact X is activated, in response to rotation of crown 16 while in a correction position.

The time-zoning device, besides the function for which it is designed, further enables, in conjunction with bidirectinal motor 23, the day of the month displayed by disc 20 to be easily and rapidly modified after a change of cell.

The watch could also be time set electronically by signals generated by a time setting circuit, not shown but known, that activates first motor 2 in response to a rotation of crown 16.

To facilitate this operation, motor 2 should also be bidirectional.

We claim:

1. An electronic watch which comprises:

a time keeping circuit able to generate a time base signal;

a first motor activatable by said time base signal;

a control mechanism including a first gear-train arranged to be driven by said first motor, a contact activatable daily by said first gear-train as the watch switches from one day to the next to generate a daily signal, and a correction number;

analogue time display means arranged to be driven by said first gear-train, and alterable by said correction member;

a perpetual-calendar circuit including day, month and year counters connected in series, and a correction circuit linked to the month and year counters, for setting to 1 the contents of the day counter at the end of each short month, said calendar being also arranged to generate, in response to the daily signal applied to the input of the day counter, a calendar signal, representative of the contents of the counters, showing the date and taking into account, by virtue of the correction circuit, the number of days in each month of the year and leap years, and a monthly signal as the calendar signal switches from one month to the next;

a second motor;

a second gear-train arranged to be driven by said second motor;

analogue display means for displaying the day of the month and controlled by said second gear-train;

a control circuit, connected to the calendar circuit and arranged to receive, in addition, said daily signal and a retrieval signal having a frequency greater than that of said daily signal, for issuing a control signal to said second motor, said control signal serving to alter the day of the month display by one day in response to said daily signal, and by the required number of days at the end of a short month in response to said retrieval signal, whereby the day of the month display will agree with the contents of the day counter on the first day of each month;

a cell for supplying energy to said circuit;

a reprogrammable non-volatile memory;

a first transmission circuit for transferring, as each day, each month and each year moves on to the next, the contents of said day, month and year counters, respectively, to said perpetual memory;

a replacement cell detection circuit arranged to generate a detection signal when the voltage of said replacement cell is applied across said circuits; and a second transmission circuit for transferring, in response to said detection signal, the contents of said non-volatile memory to the counters of said calendar circuit.

2. A watch as in claim 1, which further comprises a contact arranged to be activated by said display means when the latter displays day 1 of a month and then to issue a signal to said control circuit for putting, on day 1 of each month, the day displayed by said display means in agreement with the contents of the day counter.

3. A watch as in claim 2, wherein the control circuit comprises:

an AND gate having a first input for receiving the monthly signal, a second input for receiving the retrieval signal and a third input for receiving the day of the month signal;

an OR gate having a first input for receiving the output signal of said AND gate and a second input for receiving the daily signal; and a drive circuit for receiving the output signal of said OR gate and for issuing said control circuit to said second motor.

* * * * *